United States Patent [19]

Gobel et al.

[11] Patent Number: 4,703,860

[45] Date of Patent: Nov. 3, 1987

[54] DISK SCREEN WITH DECREASING SIZE OF SLOT OPENINGS, AND METHOD

[75] Inventors: Richard Gobel, Scappoose; Joseph B. Bielagus, Tualatin, both of Oreg.

[73] Assignee: Beloit Corporation, Beloit, Wis.

[21] Appl. No.: 865,811

[22] PCT Filed: Apr. 24, 1986

[86] PCT No.: PCT/US86/00838

§ 371 Date: Apr. 24, 1986

§ 102(e) Date: Apr. 24, 1986

[51] Int. Cl.[4] ..... B07B 1/15

[52] U.S. Cl. ..... 209/672; 209/279

[58] Field of Search ..... 209/671, 672, 667, 233, 209/234, 263, 274, 279

[56] References Cited

U.S. PATENT DOCUMENTS

| | | | |
|---|---|---|---|
| 1,200,241 | 10/1916 | Ritchie | 209/672 |
| 2,699,253 | 1/1955 | Miller | 209/672 |
| 3,663,142 | 5/1972 | Cafarelli | 209/672 X |
| 4,377,474 | 3/1983 | Lindberg | 209/672 X |
| 4,430,210 | 2/1984 | Tuuha | 209/672 X |
| 4,479,581 | 10/1984 | Kelyman, Jr. | 209/672 X |

*Primary Examiner*—Randolph A. Reese
*Assistant Examiner*—Scott H. Werny
*Attorney, Agent, or Firm*—Dirk J. Veneman; Raymond W. Campbell; Gerald A. Mathews

[57] ABSTRACT

A disk screen, and method wherein the material, such as wood chips for making paper pulp, is screened through a rotary disk screening bed (12) having zones wherein the space between disk slots (20) decreases from zone to zone as the material passes from the inlet end to the outlet end of the screen. Such spaces may range in zones from 8 mm to 6 mm along the screening bed (12).

10 Claims, 4 Drawing Figures

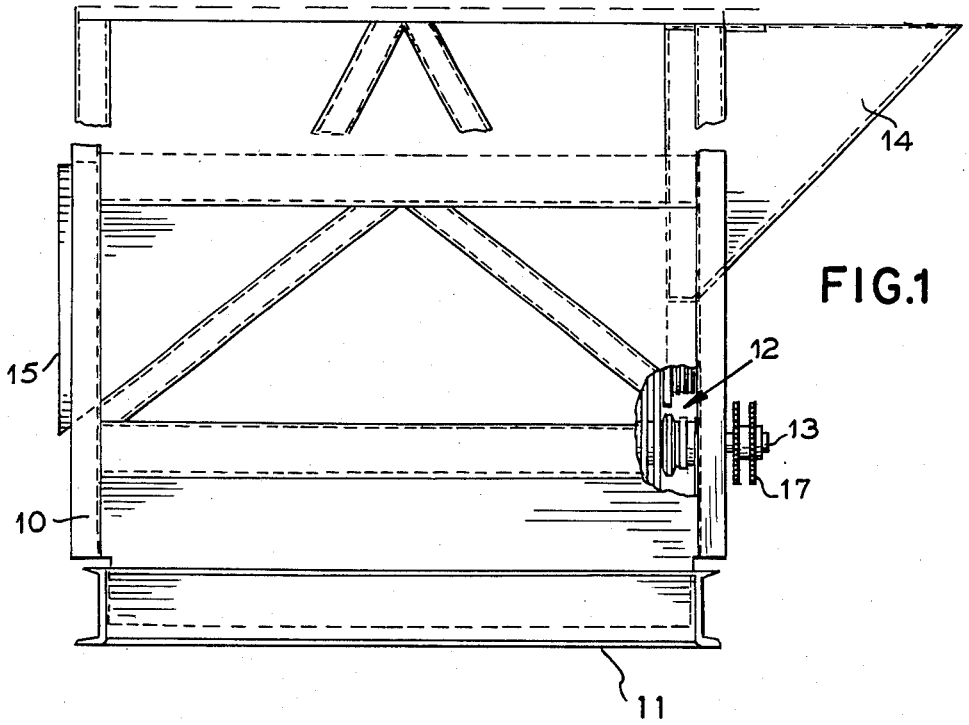
FIG.1
FIG. 4
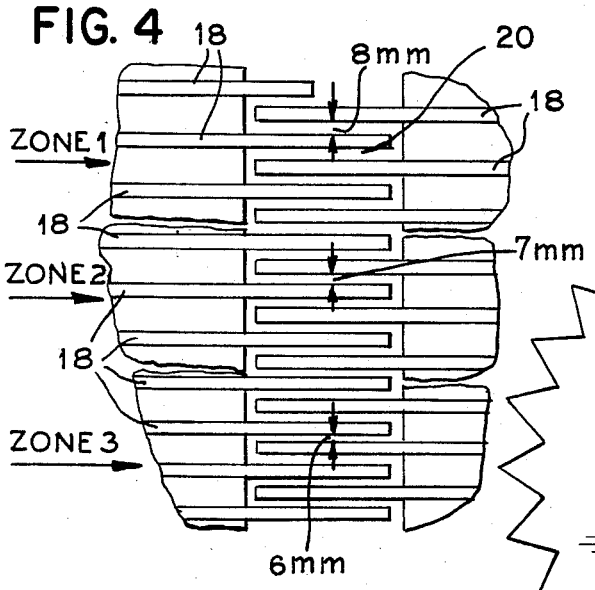
FIG. 2
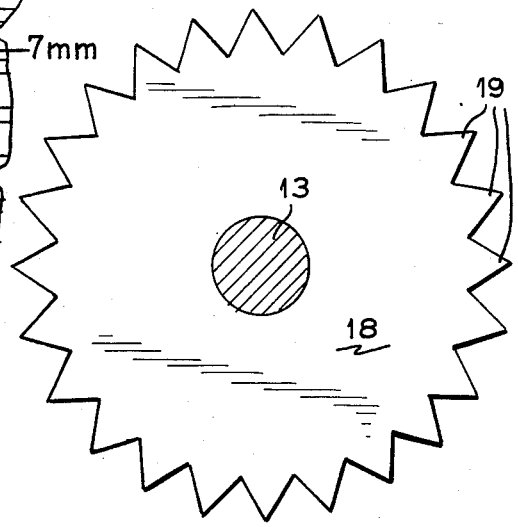

DISK SCREEN WITH DECREASING SIZE OF SLOT OPENINGS, AND METHOD

DESCRIPTION

This invention is directed to disk screens of the kind exemplified in U.S. Pat. 4,377,474, wherein the screening bed is defined by rotary screen disk shafts extending in spaced parallel relation from an intake end to a discharge end of the bed, and especially suitable for screening particulate material such as wood chips intended for use in producing paper pulp.

As disclosed in that patent, the parallel shaft assemblies carry screen disks which are interdigitated with the disks of adjacent shaft assemblies in a substantially uniform interface screening opening space or slot relation.

In wood chip screening with the just-described disk screen, a problem has been encountered in that as the chips progress down the length of the screening bed, the volume decreases in proportion to the length of the bed. As the volume decreases, the chips that are nominally larger than the interface openings have a progressively greater likelihood of finding their way through the screen slots due to inaccuracies in the disk spacings. Such inaccuracies are liable to occur due to manufacturing limitations in fabricating the relatively heavy gauge material from which the disks are fashioned, as well as the spacers between disks. As the oversize particles work into the interface openings or screening slots between the disks, they may be pinched and squeezed through the slots, and interfere with the desired uniformity of the screened product.

It is to the alleviation of the stated problem that the present invention is directed.

Accordingly, there is provided in a disk screen of the kind referred to a differential variance in the screening slot spaces along the length of the bed, for attaining greater screen efficiency. More particularly, the screening bed desirably has zones of progressively diminishing interface screening slot openings between the interdigitated screen disks from the intake end to the discharge end of the screening bed.

Other objects, features and advantages of the present invention will be readily apparent from the following description of preferred embodiments thereof, taken in conjunction with the accompanying drawings, although variations and modifications may be effected without departing from the spirit and scope of the novel concepts of the disclosure, and in which:

FIG. 1 is a partially cutaway side view of a disk screen apparatus embodying the invention.

FIG. 2 is a side elevational view representative of one of the disks of the kind mounted on the screen disk shafts of the apparatus.

FIG. 4 is a fragmental enlarged plan view of a portion of the screening bed of the apparatus illustrating the progressive differential variance in the interface screening openings or slots along the length of the bed for attaining greater screen efficiency.

Figure 3:
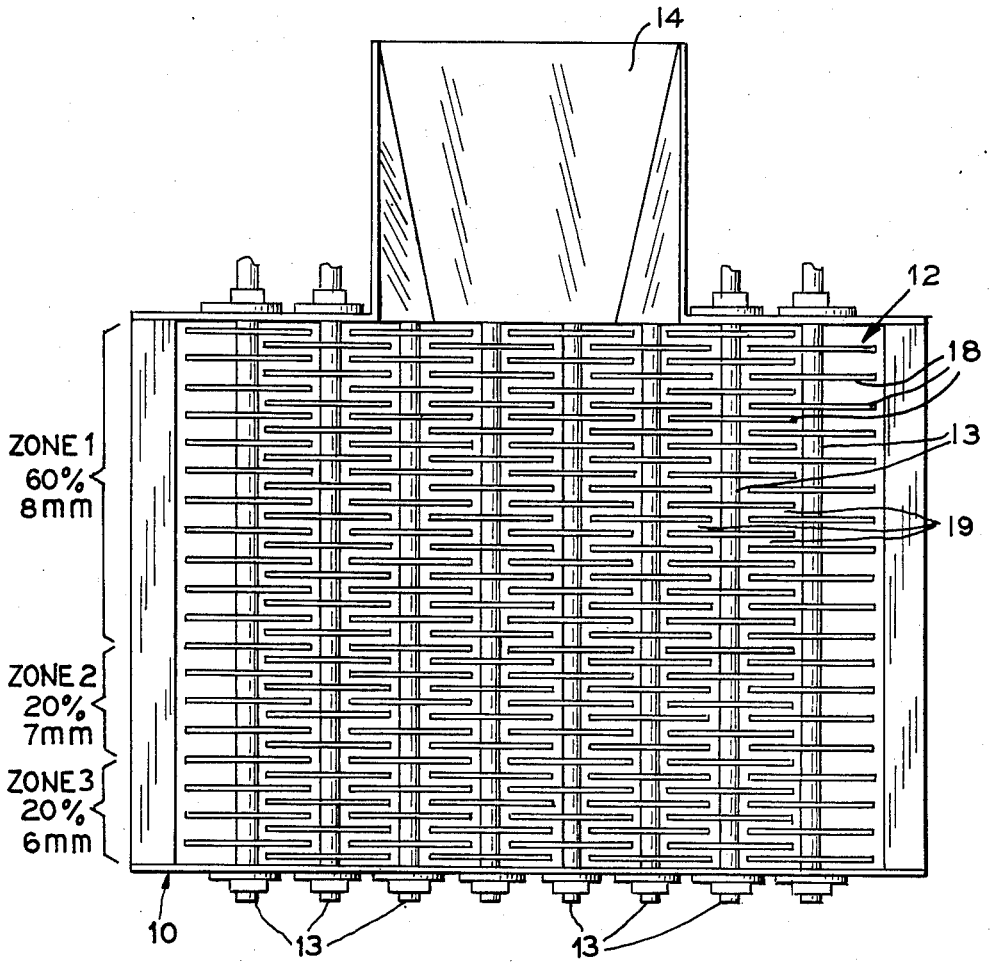
FIG. 3 is a top plan view of the apparatus of FIG. 1.

Except for differential variance in the interface screening opening or slot spaced relation between disks in the screening bed, the apparatus disclosed in the drawings may be substantially the same as disclosed in the aforesaid U.S. Pat. No. 4,377,474. Thus, referring to FIG. 1, the apparatus includes a frame 10 mounted on a base 11 carrying a screening bed 12 (FIGS. 1 and 3) defined by rotary screen disk shafts 13 extending in spaced parallel relation longitudinally from an inlet end provided with means such as a chute 14 by which particulate material such as wood chips intended for use in making paper pulp are directed to the intake end of the screen for screening of suitably refined, i.e., small size, fractions of the chip while coarser material advances on the screening bed to the opposite end of the screen, and is discharged from an outlet 15 (FIG. 1). Each of the shafts 13 is suitably rotatably mounted in the frame 10 and may be driven by means such as a chain drive 17 for rotation as intended for screening purposes, and as more particularly described in the aforesaid patent.

Each of the shafts 13 carries a set of spaced screen disks 18 (FIG. 2) corotatively fixed thereon. The disks 18 are desirably of the known toothed perimeter type having a uniform series of teeth 19 extending about their entire perimeters.

In the screening bed 12, the disks 18 of each of the shafts are interdigitated with the disks of adjacent shafts in predetermined interface screening opening spaced relation to provide screening slots 20 between the adjacent faces of the interdigitated disks. In a typical example, as shown, there may be nineteen of the disks 18 on each of the shafts 13. Where screened comminuted chip particles of no greater than 8 mm are desired, the slots 20 may be no wider than 8 mm.

However, as pointed out hereinbefore, as the mass of chips progresses down the length of the screening bed 12 the volume decreases in proportion to the length of the bed as the desirable screened out fraction of the chips falls through the bed. If the same spacing prevails throughout the length of the screen, there is the liability of nominally larger chips finding their way through the screen slots 20 with detrimental effect, at least to the quality, i.e., uniformity, of the screened chip fraction.

In order to attain substantial uniformity, and at least to avoid larger than desired particles from passing through the screening bed 12 as the volume of chips diminishes progressively downstream, a differential variance in the spaced relation of the slots 20 along the length of the screening bed is provided by progressive screening zones thereby attaining the desired greater screening efficiency. For example, as shown in FIGS. 3 and 4, the screening bed 12 may be provided with a first zone for about the first 60% of its length starting at the inlet 14, such zone having slot spacings of about 8 mm. Then, in a second zone extending beyond the first zone for about 20% of the length of the screening bed 12, the slots 20 may be about 7 mm in width. In the remaining about 20% third zone, the slot width may be about 6 mm.

As a result, the chips dropping through the first zone of the screening bed 12 will be predominantly within a range which will pass relatively freely through the 8 mm slots. In the downstream second and third zones only finer chips than will pass through the first zone will pass through the screening bed. Material coarser than will easily pass through the 8 mm slots 20 of the first zone will thus be precluded from passing through the screen, but will be discharged from the discharge end 15 of the apparatus to be discarded or to be further worked, whatever may be desired.

Although a particular differential variance arrangement of 60/20/20 in a three zone arrangement has been particularly disclosed, it will be appreciated that there may be numerous variations depending upon the quality, condition and particular requirements desired in the material being screened. That is, the specific spacings between the disk faces defining the screening slots 20, the particular zone length percentage ratios, and the number of screening zones may vary to meet numerous parameters and requirements. By way of example the first zone may extend from about 10 to 70 percent of the screening bed length, the second zone may extend from about 20 to 50 percent of the bed length, and the third zone may extend from about 20 to 50 percent of the bed length, in desired permutations. In some instances, only two zones of differential slot width may be sufficient. On the other hand, more than three zones may be desirable if conditions and requirements warrant.

It will be understood that variations and modifications may be effected without departing from the spirit and scope of the novel concepts of this invention.

We claim:

1. In a disk screen of the kind having a continuous screening bed defined by rotary screen disk shafts extending in spaced parallel relation longitudinal from an intake end to a discharge end of the bed and especially suitable for use in screening material such as wood chips for making paper pulp:

said shafts carrying spaced screen disks interdigitated with the disks of adjacent shafts in predetermined interface screening slot opening spaced relation; and a differential variance in said spaced relation along the length of said continuous bed for attaining greater screening efficiency;

said differential variance including a plurality of zones wherein the interface slot openings between the interdigitated screen disks progressively diminish from zone to zone, starting at said intake end and extending to said discharge end of the screening bed for subjecting material not passing through said bed to progressively smaller interface slot openings as the material passes from zone to zone.

2. A disk screen according to claim 1, wherein said screening zones include a first zone extending from about 10–70 percent of the length of the screening bed, a second zone extending from about 20–50 percent of the screening bed length, and a third zone extending from about 20–50 percent of the screening bed length.

3. A disk screen according to claim 1, wherein said zones comprise a first zone of about 60% of the length of the screening bed, and second and third zones comprising about 20% each of the length of the screening bed.

4. A disk screen according to claim 3, wherein the interface slot openings are about 8 mm in the first zone, 7 mm in the second zone and 6 mm in the third zone.

5. A disk screen according to claim 1, wherein said differential variance is within a range of from about 8 mm to about 6 mm in the interface slot openings.

6. A method of screening particulate material such as wood chips intended for use in making paper pulp, comprising:

depositing the material on a rotary screen disk shaft screening bed extending from an intake end to a discharge end and comprising spaced interdigitated disks; and in the travel of the material from the intake end to the discharge end along the screening bed screening the material through screening slots between said disk arranged in zones wherein the interface slot openings progressively diminish from zone to zone starting at said intake end and extending to said discharge end of the screening bed for attaining greater efficiency.

7. A method according to claim 6, comprising screening the material through a first screening zone extending from 10–70 percent of the length of the screening bed, then through a second zone extending from 20–50 percent of the screening bed length, and then through a third zone extending from 20–50 percent of the screening bed length.

8. A method according to claim 6, comprising screening the material through a first zone comprising about 60% of the length of the screening bed, and then successively through second and third zones comprising about 20% each of the length of the screening bed.

9. A method according to claim 8, comprising screening the material through interface slot openings of about 8 mm in the first zone and then through slot openings of about 7 mm in the second zone and about 6 mm in the third zone.

10. A method according to claim 6, which comprises screening said material through screening slots having differential width variance within a range of from about 8 mm to about 6 mm.

* * * * *